US007047702B1

(12) United States Patent
Callens et al.

(10) Patent No.: US 7,047,702 B1
(45) Date of Patent: May 23, 2006

(54) PERIMETER ANGLE TRIM

(75) Inventors: Jean-Pierre Callens, 28500 Vernouillet (FR); Gerard Quentin, 28250 Digny (FR)

(73) Assignee: USG Interiors, Inc., Chicago, IL (US)

( * ) Notice: Subject to any disclaimer, the term of this patent is extended or adjusted under 35 U.S.C. 154(b) by 97 days.

(21) Appl. No.: 10/843,521

(22) Filed: May 11, 2004

(51) Int. Cl.
*E04C 2/38* (2006.01)

(52) U.S. Cl. ..... 52/716.1; 51/716.8; 51/718.04; 51/664; 51/666; 51/668; 403/292; 403/294; 403/345

(58) Field of Classification Search ..... 52/664, 52/666, 726.2, 726.1, 506.07, 662, 668, 671, 52/716.1, 716.8, 718.04, 718.01, 718.05, 52/717.03, 717.04; 403/300, 349, 292, 294, 403/381, 364, 301, 297, DIG. 4
See application file for complete search history.

(56) References Cited

U.S. PATENT DOCUMENTS

| | | | | | |
|---|---|---|---|---|---|
| 397,535 | A | | 2/1889 | Carroll | |
| 747,253 | A | * | 12/1903 | Smith | 52/718.04 |
| 2,821,754 | A | | 2/1958 | Hillson | |
| 3,305,255 | A | | 2/1967 | Henderson | |
| 3,331,171 | A | * | 7/1967 | Hallock | 52/278 |
| 3,703,747 | A | * | 11/1972 | Hamman | 24/289 |
| 3,722,167 | A | | 3/1973 | Rousey | |
| 3,782,084 | A | * | 1/1974 | Harkness | 56/10.5 |
| 4,520,608 | A | * | 6/1985 | Baus | 52/718.04 |
| 4,525,973 | A | * | 7/1985 | Vukmanic et al. | 52/667 |
| 5,138,759 | A | * | 8/1992 | Gruetzmacher | 29/467 |
| RE34,547 | E | | 2/1994 | Weldy | |
| 5,440,844 | A | | 8/1995 | Chihara et al. | |
| 5,482,596 | A | * | 1/1996 | Wu | 562/406 |
| 5,526,617 | A | * | 6/1996 | Grice | 52/287.1 |
| 5,555,687 | A | * | 9/1996 | Logan et al. | 52/288.1 |
| 5,761,868 | A | * | 6/1998 | LaLonde et al. | 52/506.07 |
| 5,921,056 | A | * | 7/1999 | Weiss et al. | 52/745.16 |
| 6,122,872 | A | * | 9/2000 | Sauter | 52/288.1 |
| 6,339,891 | B1 | * | 1/2002 | Cox | 40/785 |

* cited by examiner

*Primary Examiner*—Jeanette E Chapman
(74) *Attorney, Agent, or Firm*—Pearne & Gordon LLP

(57) ABSTRACT

A wall molding for suspended ceiling systems has a self-aligning feature adapted to locate one end of a piece being installed on the end of a previously installed piece so that an installation of high quality workmanship is quickly obtained. The self-aligning feature is in the form of a tongue extending longitudinally beyond a faux end and adapted to nest in the previously installed piece. The tongue fits within the spaces between hems on the longitudinal edges of legs of a right angle cross-section and the opposed legs so that the tongue is laterally restrained in the planes of the legs and is longitudinally restrained by abutting end edges.

10 Claims, 2 Drawing Sheets

PERIMETER ANGLE TRIM

BACKGROUND OF THE INVENTION

The invention relates to improvements in suspended ceiling componentry and, in particular, to an improved wall molding for suspended ceiling systems.

PRIOR ART

Typically, a suspended ceiling includes a wall molding at the intersection of the wall and plane of the ceiling. The wall molding serves to support the edges of ceiling tiles and serves to conceal these edges to provide a finished appearance. The wall molding, typically, can also support the ends of tees comprising the grid carrying the ceiling tiles. Conventional wall moldings are manufactured as elongated angles, typically being roll-formed from strips of prefinished sheet metal. Premium or commercial grade wall angles can have a reinforcing hem along the free edges of their legs. The wall molding or angle ordinarily is installed at the desired height on a wall by suitable fasteners such as screws, nails, staples or the like. The height may be determined by a chalk line, laser level or other method. In any case, a problem encountered by the installer with conventional wall molding is the difficulty in holding it level and abutted against a previously installed piece and fastening it to the wall all at the same time. The task is also difficult because the manufactured length of the wall molding is considerable in comparison to its transverse dimensions, so that it is not perfectly rigid.

Additionally, because of the length of a standard wall molding, it is difficult to register the end of a new piece with the end of the previously installed piece while holding the new piece at or near its mid-length. These difficulties add to the time required to install the wall molding, particularly when care is taken to mount the molding in a straight line at an exact height and in registry with a previously installed length of molding.

SUMMARY OF THE INVENTION

The invention provides a wall molding with an extension or formation that enables it to self-align with a previously installed piece. The self-aligning feature permits the wall molding to be installed with less time and greater accuracy in positioning when compared to prior art products. With the self-aligning feature of the invention, the wall molding can be easily registered endwise and laterally with a previously installed piece. The self-aligning feature of the invention is capable of vertically supporting and laterally holding the associated end of the wall molding. As a result, the installer is relieved of a need to concentrate on positioning and aligning this end of the molding and can advantageously direct his/her attention to supporting and fastening a mid-length portion of the molding to initially fasten the molding to the wall.

In a preferred embodiment of the invention, the self-aligning feature has the form of a right angle extension or tongue created by parts extending from each leg of the wall molding proper, i.e. the main body of the wall molding. The tongue elements or parts are stepped out of but parallel to the planes of their respective legs a distance substantially equal to the thickness of the legs. This step or offset of the alignment or tongue elements allows them to hold the legs of adjacent ends of a pair of moldings in alignment. With the legs held in alignment by the disclosed tongue parts, only a very moderate longitudinal force on the molding is needed to establish and maintain a good end-to-end fit between wall molding pieces that has the appearance of a butt joint.

DESCRIPTION OF THE PREFERRED EMBODIMENT

Figure 2:
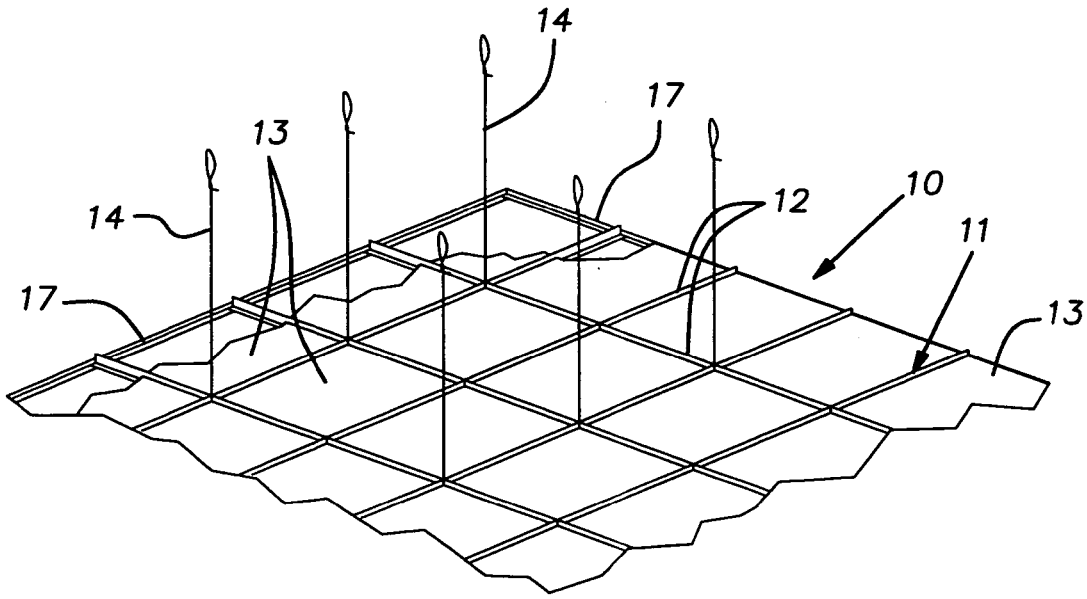
FIG. 2 is a fragmentary perspective overhead view of a suspended ceiling system employing the wall molding of the invention.
Figure 3:
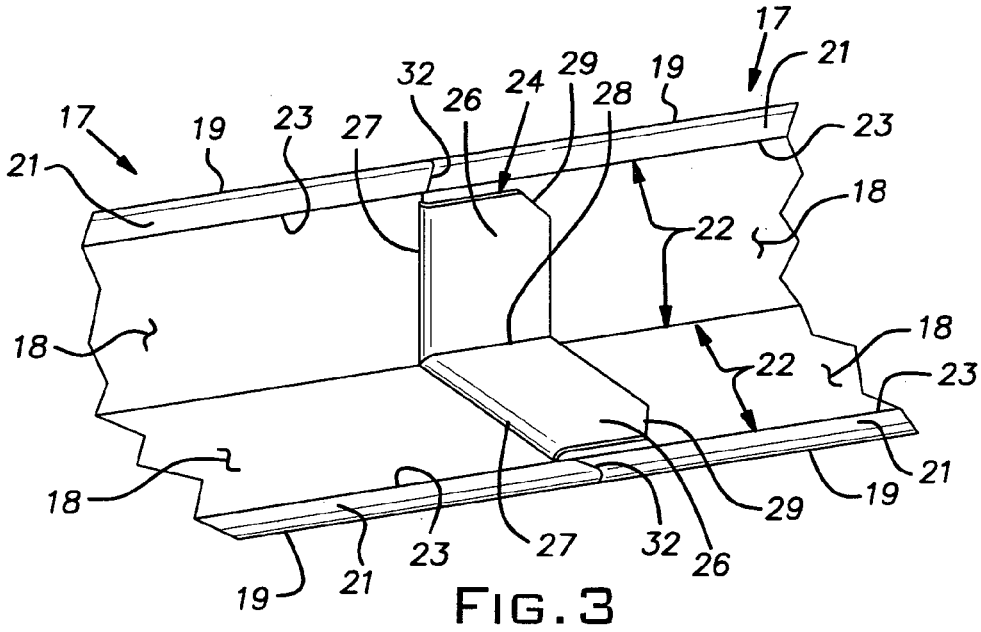
FIG. 3 is an enlarged fragmentary view of a joint between the ends of a pair of wall moldings showing the alignment feature of the invention.
Figure 4:
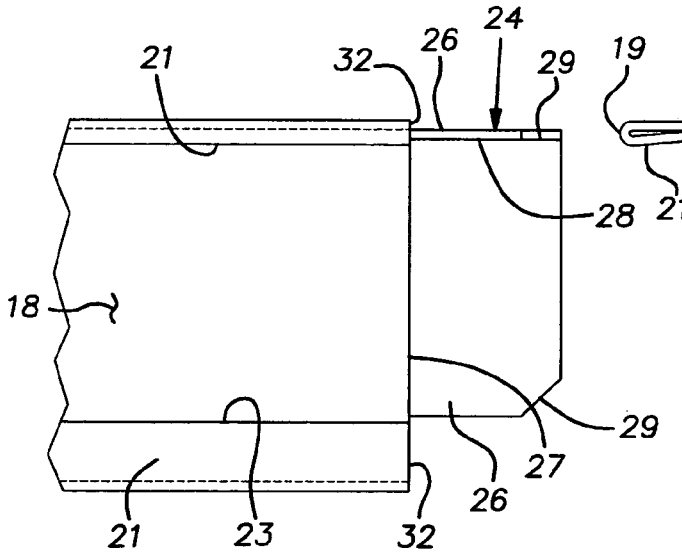
FIG. 4 is a fragmentary plan view of the end of a wall molding including the self-aligning feature of the invention.

Referring now to the drawings and in particular to FIG. 2, a conventional suspended ceiling system 10 includes a rectangular grid 11 of inverted metal tees 12 on which is carried rectangular or square lay-in panels or tiles 13. The tees 12 are typically suspended with wires 14 from an overhead superstructure. The edges of the ceiling system, where the ceiling meets the walls, designated 16, of a building, are finished or trimmed with a wall molding 17.

The wall molding 17 is in the form of a right angle having perpendicular generally planar legs 18 which, in the illustrated embodiment, are of equal width. As is conventional, the wall molding can be manufactured by roll-forming sheet metal, typically steel, which is pre-painted. The legs 18, at their longitudinal free edges 19, have a roll-formed hem 21 where the sheet metal stock is bent back over itself to stiffen the edge and provide a finished appearance. The hem 21 of folded over material normally has a width substantially less than the width of its associated leg 18, so as to leave a gap 22 between an inner edge 23 and the opposite leg 18. At one end of the wall molding 17, a longitudinally extending tongue 24 is provided, in accordance with the invention, to afford a self-alignment feature. The opposite end of the wall molding 17 is plain without a tongue and simply sheared across a plane transverse to the longitudinal direction of the wall molding. The tongue 24 in the preferred embodiment is formed integrally as one piece with the main body of the wall molding 17, i.e. the wall molding proper. The tongue 24 has integral, mutually perpendicular planar parts 26 protecting longitudinally from a respective one of the legs 18 of the wall molding proper. Each tongue part 26 is stepped out of and is parallel to the plane of its respective leg 18 preferably by a distance generally equal to the thickness of the stock forming the wall molding 17. Relatively small web or bridge elements 27 lying in a common plane transverse to the longitudinal direction of the wall molding 17 form the transition between the legs 18 and the tongue parts 26. The tongue parts 26 are integrally joined as one piece at a corner 28. Ideally, the length of the tongue 24, i.e. the distance it projects longitudinally from the wall molding proper, is less than the width of the legs 18. The width of each tongue part 26 is, preferably, slightly less than the gap 22 between its adjacent hem 21 and the opposed leg 18. Corners 29 of the free ends of the tongue parts 26 are beveled or clipped.

By way of example, but not limitation, the wall molding has a nominal length of 10 or 12 feet; the legs 18 are ⅞" wide; and, the thickness of the sheet stock forming the wall molding is between about 0.015" to about 0.030".

In a typical installation, the wall molding 17 is attached to a vertical wall 16 at a height and orientation where one of its legs 18 lies at the plane of the ceiling system surface visible from below and the other leg 18 extends upwardly in abutting contact with the wall 16. Typically, the wall molding 17 is attached with screws, nails or other fastening means ordinarily at regularly spaced locations. The elevation of the wall molding 17 can be set by a laser, chalk line or other known technique. Because the usual length of a piece of wall molding 17 is great as compared to the transverse dimensions of the legs 18, the wall molding is somewhat flexible and, therefore, difficult to maintain relatively straight where it is temporarily supported at only one or two points along its mid-length. This characteristic has made it difficult with prior art wall molding products to quickly and accurately manually position a length of wall molding in proper registration with the end of a previously installed piece of wall molding and in line with the desired location and, at the same time, fix the wall molding in place with a fastener.

Figure 1:
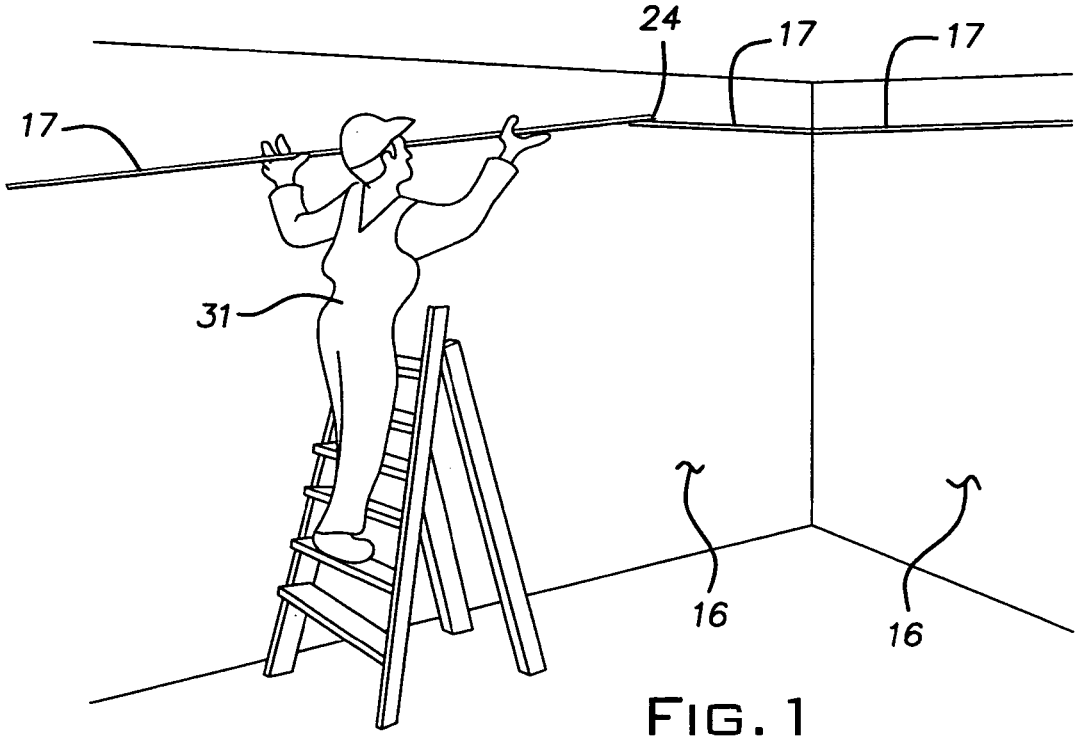
FIG. 1 is a somewhat schematic perspective drawing of a workman installing a wall molding constructed in accordance with the present invention.

After the first piece of wall molding 17 has been installed, subsequent pieces are conveniently and quickly installed with the benefit of the invention. The invention facilitates installation of a wall molding 17 such as in a manner represented in FIG. 1. An installer 31, holding the wall molding 17 near its mid-length can lay the end portion associated with the tongue 24 on the plain end of the previously installed piece of wall molding 17. The installer 31 can then level the new piece out to the desired elevation and, if more than the tongue 24 is overlapping the plain end of the previously installed piece, simultaneously or subsequently pull the piece away from the preceding piece until only the tongue is in overlapping contact with the previous piece. Thereafter, the piece 17 being installed can be lightly forced against the preceding piece to achieve the appearance of a tight butt joint at a transverse faux end plane where the tongue 26 extends from the legs 18. At this time, the wall molding piece being installed can be readily fixed in place with a fastener near its mid-length while the installer need only support the wall molding with one hand since the previously installed wall molding 17 is supporting and locating the new piece through the medium of the tongue 24.

The geometry of the tongue 24 has certain benefits. The offset of the tongue parts 26 from the planes of respective legs 18 assures that the legs 18 of a pair of joined wall molding pieces are in planar alignment. The tongue parts 26 fit in the space or gap 22 between the hem edge 23 and the opposed leg 18 of the joined wall molding piece thereby producing a laterally locked condition of the tongue in the planes of both legs 18. The tongue 24, being shorter than the width of the legs 18, enables it to remain without modification or removal when a corner joint between perpendicular walls 16 is established between two wall angles. The beveled or otherwise trimmed corners allow the tongue 24 to slide longitudinally in the gaps 22 between the hems 21 and opposed legs 18 without jamming. The limited width of the tongue parts allows the end edge areas 32 of the legs 18 laterally outward of the bridge elements 27 including the ends of the hems 21 to abut the plain end of the mating previously installed piece 17 so that any tendency for the bridge elements 27 of the new piece to ride up over the previously installed piece under a longitudinal compressive force is suppressed. This abutting action is assured because the height of the hems 21 from the plane of their respective legs is greater than the thickness of the leg stock so that the hem end edges of the plain end snag the opposing end edges 32.

Figure 5:
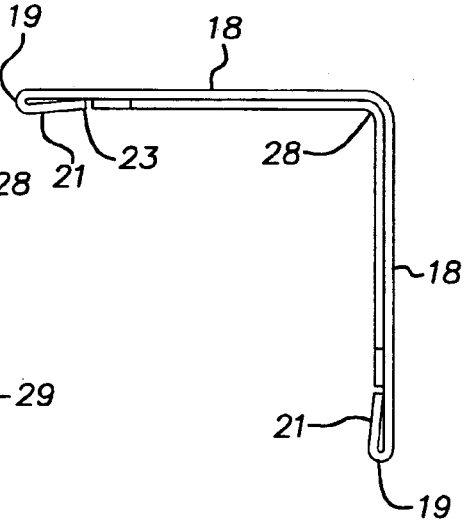
FIG. 5 is an end view of the self-aligning feature of the invention.

The following more fully explains the role of the hems 21 in establishing a positive end-to-end relationship between a pair of wall moldings. The depiction of the area of the hems 21 in the view of FIG. 5 is somewhat schematic. Generally, it is the practice in the industry that the inside of the bend at the longitudinal edge of each leg that forms the hem has a measurable radius such that a space exists between the hem and the leg proper, at least at and near the bend. The end edges are typically created by a shear blade that moves in a direction transverse to the longitudinal direction of the wall molding and along a line that bisects the 90° angle between the legs 18. The shear blade can operate from the space included between the 90° spacing between the planes of the legs or from the other side of the wall molding, i.e. the space of the 270° angle between the legs. Depending on the space from which the shear operates, the hems 21 may tend to be permanently deformed towards the leg proper or away from the leg proper. In the former case, the effective thickness of the legs, including the partially flattened hem will normally be more than twice the thickness of the sheet stock. As described above, the bridge elements 27 are proportioned to space the tongue parts 26 a distance equal to the thickness of the material stock from the planes of the legs proper. Additionally, the bridge elements 27 are formed so that they exist mostly and, preferably, exclusively longitudinally rearwardly of the plane of the end edges 32 of the legs and hems. The functional result of the described end edge structure and the bridge element structure is that a longitudinal compressive force between a wall molding piece being installed and the previously installed piece does not produce a camming action by the bridge elements 27 which could otherwise allow the wall molding piece being installed to slip onto and over the previously installed piece. This potential camming action is prevented by abutting contact between the end edges of the wall molding associated with the tongue and the opposing edges of the plain end of an identical wall molding. Even if the tongue 24 and plain ends are misaligned by a distance equal to the thickness of the sheet stock, as might occur if the bridge elements 27 operate as camming elements, the effective thickness at the hems, being more than double the stock thickness, assures that at least portions of the end edges abut so as to prevent over-riding of the tongue end past the plain end. Also, if the tongue and plain ends of a pair of wall moldings being joined are angularly misaligned about their longitudinal axis, one of the end edges 32 will typically catch on the edge of the opposing plain end with the associated tongue part resting in the space or pocket formed by the hem of the plain end.

Other known wall moldings with cross-sections different than the illustrated right angle, equal leg width molding can be provided with the self-alignment feature of the invention. For example, the legs can have unequal widths, e.g. 1" by 1½" and/or the cross-sections can be modified J or C-shapes, or can be stepped. In some instances, a leg can have a width as much as about 1½% of the length of the molding. Where desired, a wall molding incorporating the invention can be formed of other suitable materials and processes besides roll-formed sheet steel, such as roll-formed sheet aluminum, aluminum extrusion, or plastic extrusion of polycarbonate or the like.

It should be evident that this disclosure is by way of example and that various other changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An elongated wall molding for use at the perimeter of a suspended ceiling system by attachment to a wall structure and for supporting the edge areas of lay-in ceiling tiles, the molding having a length defined between first and second ends and having perpendicular generally planar legs, the legs having a width substantially less than the length of the molding and a thickness substantially less than their width, the first end having at least one of the end edges of the legs lying in a plane transverse to the longitudinal direction of the molding, the second end having a longitudinally extending tongue, the tongue extending from the legs at a transverse faux end plane and lying in planes parallel to the planes of associated legs and offset towards a space bounded by the planes of said legs, the tongue being offset from the plane of each associated leg a distance substantially equal to the thickness of the associated leg, the tongue thereby having a right angle configuration adapted to nest in the first end of an identical wall molding whereby it is able to guide said wall molding into registration with the first end of a previously installed identical wall molding.

2. A wall molding as set forth in claim 1, wherein said tongue has a width in its respective planes less than the width of an associated leg.

3. A wall molding as set forth in claim 1, wherein said legs each have a hem at their free longitudinal edge, the hems being on a side of the legs facing the space included between said legs.

4. A wall molding as set forth in claim 3, wherein said wall molding is roll-formed sheet metal and said hems are formed by bending said sheet metal back over itself at the free edges of said legs.

5. A wall molding as set forth in claim 4, wherein the width of the tongue at each of its planes is sized to fit in a space between each associated hem and an opposed leg.

6. A wall molding as set forth in claim 5, wherein the effective thickness of the legs at the hems is more than twice the thickness of the sheet metal forming said wall molding.

7. A wall molding as set forth in claim 5, wherein said tongue has a lead edge that is beveled at laterally outer regions to enable said tongue to slip freely within the space between said hems and said opposed legs.

8. A suspended ceiling system comprising a rectangular grid of inverted tees bounded by a plurality of identical pieces of elongated wall molding attached to vertical walls and arranged end-to-end, the wall molding having the cross-sectional shape of a right angle formed by perpendicular generally planar legs, one of said legs being arranged in a horizontal plane and the other of said legs extending vertically upwardly from said one leg and abutting a wall to which it is attached, one end of said wall molding pieces having a plain configuration formed by edges lying in a common plane transverse to the longitudinal direction of the wall molding piece, the other end of said wall molding pieces having an integral longitudinally extending tongue, the tongue extending over the plain end of an adjacent wall molding, contacting portions of the adjacent wall molding, and aligning its associated wall molding end to the end of the adjacent wall molding such that their respective horizontally oriented legs are co-planar.

9. A method of installing a wall molding comprising the steps of securing a first piece of wall molding to a wall at a desired height, manually supporting a second wall molding piece by gripping it at its mid-section while causing a part of the second piece adjacent a self-aligning end part thereof to overlie and contact an end area of the first piece, drawing the second piece in a direction away from the first piece until only the self-aligning part of the second piece overlies the first piece, applying a moderate longitudinal force on the second piece to cause surface areas of the second piece to abut end surface areas of the first piece and thereafter securing the second piece to the wall.

10. An elongated wall molding for use at the perimeter of a suspended ceiling system by attachment to a wall structure and for supporting the edge areas of lay-in ceiling tiles and/or the ends of tees, the molding having a length defined between first and second ends and having perpendicular generally planar legs, the legs having a width less than about 1½% of the length of the molding and a thickness substantially less than their width, the first end having at least one of the end edges of the legs lying in a plane transverse to the longitudinal direction of the molding, the second end having a longitudinally extending tongue, the tongue extending from the legs at a transverse faux end plane and lying in a plane parallel to the plane of an associated one of said legs and offset towards a space bounded by the planes of said legs, the tongue being offset from the plane of said associated leg a distance substantially equal to the thickness of the associated leg, the tongue having a configuration adapted to nest in the first end of an identical wall molding whereby it is able to guide said wall molding into registration with the first end of a previously installed identical wall molding.

* * * * *